US007392554B1

(12) United States Patent
Su et al.

(10) Patent No.: US 7,392,554 B1
(45) Date of Patent: Jul. 1, 2008

(54) POWERED PATIENT LIFT DEVICE

(76) Inventors: Fong-Chin Su, No. 68, Dong Ning Rd., East Dist., Tainan City (TW); Jyh-Jong Chang, No. 4, Alley 1, Lane 55, Da Fu St., San Min Dist., Kaohsiung City (TW); Cheng-Chun Chen, No. 68, Chong Cheng Rd., Feng Shan City, Kaohsiung County (TW)

( * ) Notice: Subject to any disclaimer, the term of this patent is extended or adjusted under 35 U.S.C. 154(b) by 0 days.

(21) Appl. No.: 11/741,442

(22) Filed: Apr. 27, 2007

(51) Int. Cl.
*A61G 7/14* (2006.01)

(52) U.S. Cl. ..... 5/86.1

(58) Field of Classification Search ..... 5/86.1, 5/81.1 R, 83.1, 89.1
See application file for complete search history.

(56) References Cited

U.S. PATENT DOCUMENTS 4,918,771 A * 4/1990 James ..... 5/87.1
5,309,584 A * 5/1994 Parker ..... 5/87.1
5,758,371 A * 6/1998 VanDyke et al. ..... 5/86.1
6,092,247 A * 7/2000 Wilson ..... 5/86.1
6,175,973 B1 * 1/2001 Hakamiun et al. ..... 5/89.1
6,449,785 B1 * 9/2002 Liljedahl ..... 5/89.1
6,568,002 B1 * 5/2003 Liljedahl ..... 5/86.1
2005/0283906 A1 * 12/2005 Summers ..... 5/86.1

* cited by examiner

*Primary Examiner*—Alexander Grosz
(74) *Attorney, Agent, or Firm*—WPAT, P.C.

(57) ABSTRACT

A powered patient lift device includes a main frame having a beam and a wheel chassis. The top of the beam is pivotally connected with a lifting arm. One end of the lifting arm is provided with a seat. A power unit is adapted to drive a lifting unit which then links the lifting arm to move. A control unit is to activate the power unit. A knee support is disposed at a lower section of the beam. The knee support is provided with a knee pad to engage with a user's knee. When the lifting unit is activated, the lifting arm is linked to move the supporting unit to assist the user to stand up or to sit down.

9 Claims, 4 Drawing Sheets

POWERED PATIENT LIFT DEVICE

BACKGROUND OF THE INVENTION

1. Field of the Invention

This invention relates to a powered patient lift device, more particularly, to a lift device to assist a disabled user to stand up, sit down or walk.

2. Description of the Prior Art

For those disabilities who have problems with their spinal nerve damage or leg muscle too weak to support their bodies, they need help to stand up, sit down or walk.

U.S. Pat. No. 6,092,247 discloses a powered patient lift vehicle for assisting physically handicapped persons in moving, which uses a pair of slings to hold the chest and legs as a stabilizer to lift the user. However, when the user is in sit down position, the body's weight is in the hip which is not supported by any device, that will lead the user to slide rearward and causes muscle tension.

SUMMARY OF THE INVENTION

This invention relates to a powered patient lift device which comprises a main frame, a lifting arm, a lifting unit, a power unit, a control unit, a knee support and a supporting unit, wherein the main frame comprises a beam and a wheel chassis; the lifting arm is pivotally connected to the main frame in a retractable manner; the lifting arm comprises a seat at one end thereof; the lifting unit is connected to the lifting arm and links the lifting arm to retract or to extend; the power unit is connected to the lifting unit and provides power to the lifting unit; the control unit controls the power unit; the knee support is disposed on the beam of the main frame and provided with a knee pad; the supporting unit has a first end pivotally connected to the knee support and a second end pivotally connected to the end provided with the seat of the lifting arm. The wheel chassis of the main frame is provided with wheels. The control unit is disposed on the main frame or is a separate part from the main frame. The lifting arm is provided with a handle. The control unit controls the power unit in a wire or wireless transmission manner. The lifting unit is a spiral rod set. The knee support is able to do vertical and horizontal adjustments. The supporting unit is a retractable rod composed of at least two sections, and is provided with a quick release connector.

It is the primary object of the present invention to provide a powered patient lift device, which is able to assist disabled people to stand up, to sit down and to walk for rehabilitation without the help of others.

It is another object of the present invention to provide a powered patient lift device, which uses electric technology to assist disabled people to stand, to sit down and to walk in a precious manner.

It is a further object of the present invention to provide a powered patient lift device, which has wheels to facilitate disabled people to move in all direction.

It is still a further object of the present invention to provide a powered patient lift device, which assists disabled people to stand up or to sit down easily.

DETAILED DESCRIPTION OF THE PREFERRED EMBODIMENT

Figure 1:
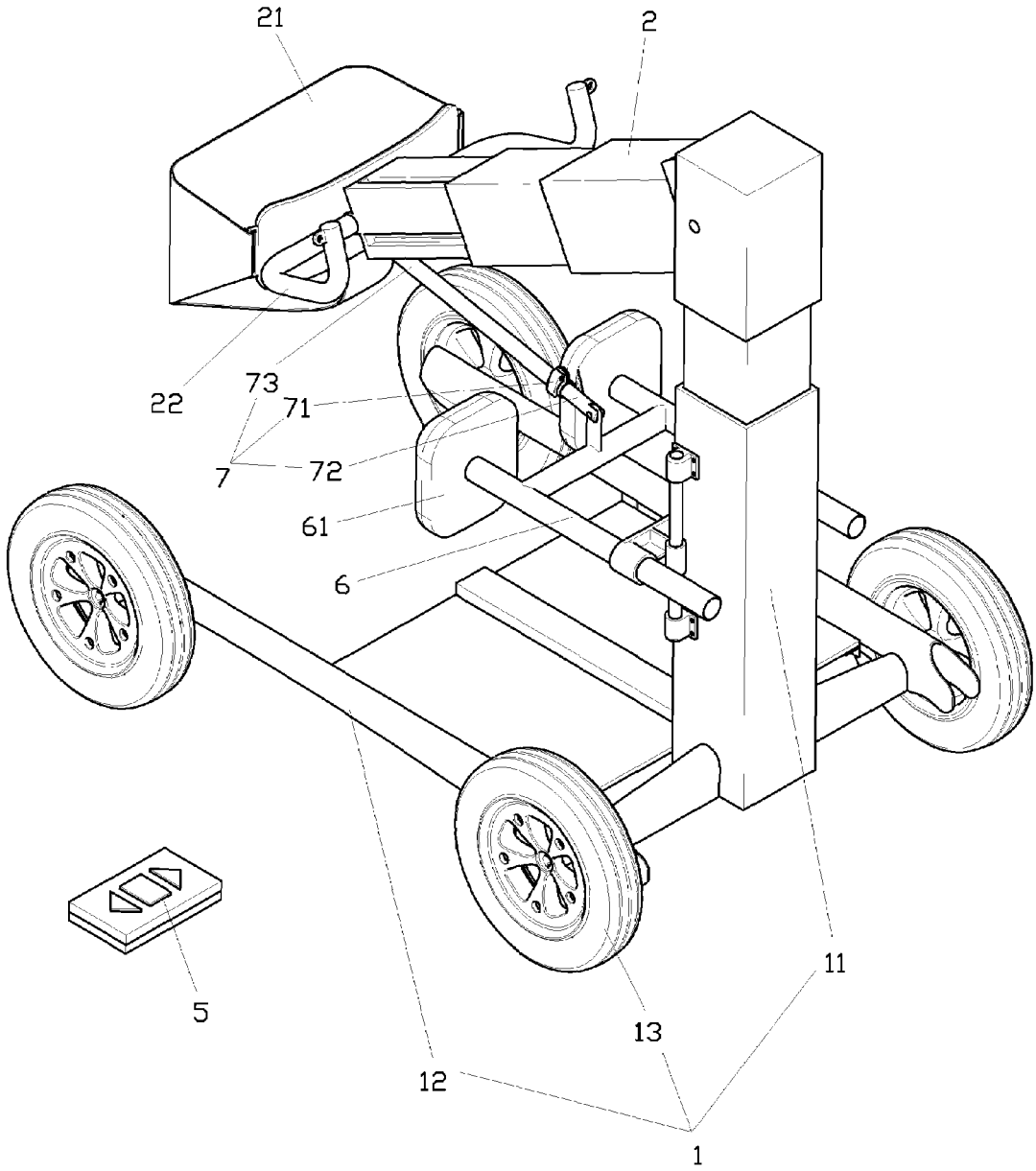
FIG. 1 is a perspective view of a preferred embodiment of the present invention.
Figure 2:
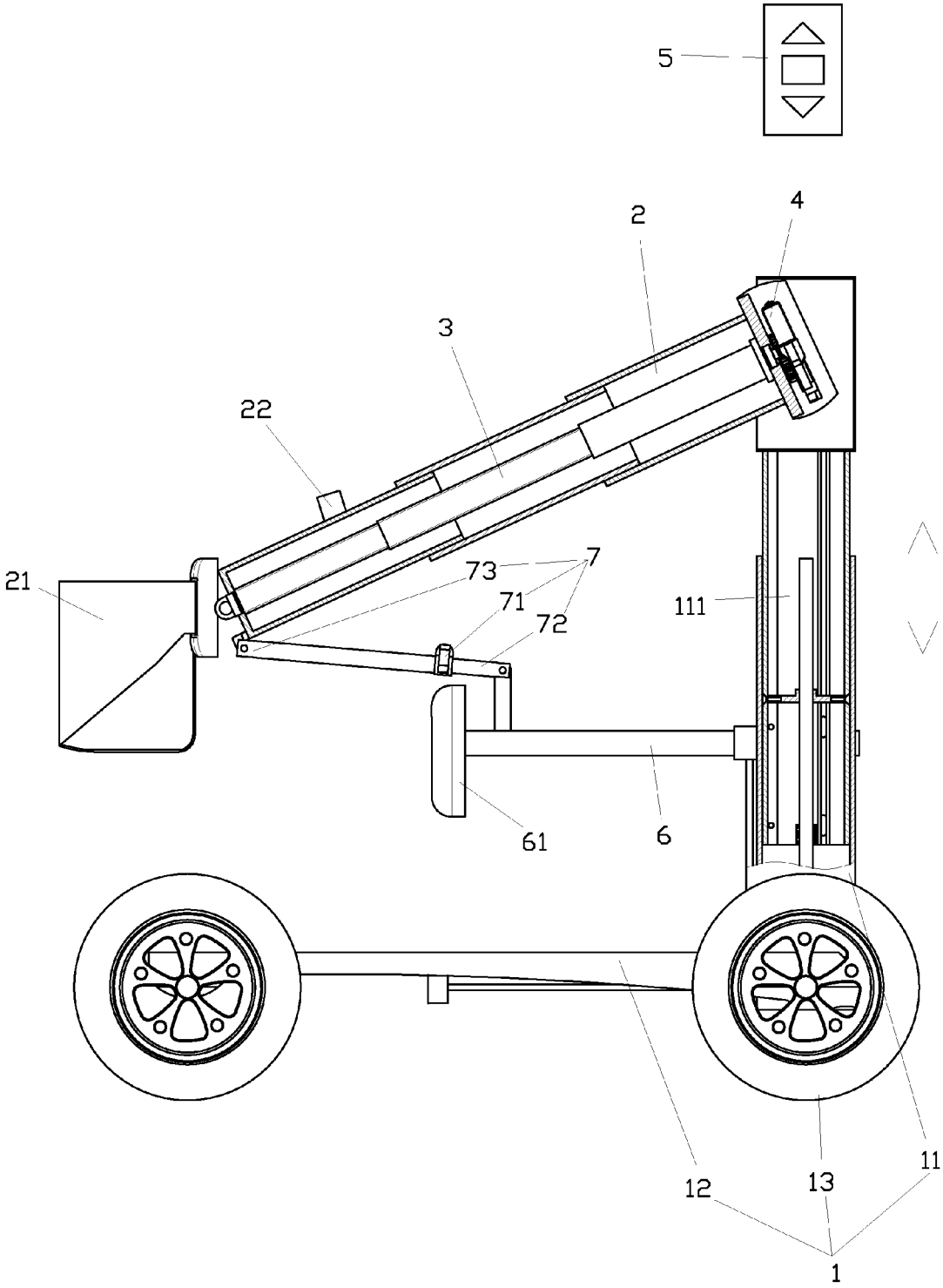
FIG. 2 is a side view of the preferred embodiment of the present invention showing that a beam of a main frame is able to adjust its height.

As shown in FIGS. 1 and 2, a preferred embodiment of the present invention comprises a main frame 1, a lifting arm 2, a lifting unit 3, a power unit 4, a control unit 5, a knee support 6 and a supporting unit 7.

The main frame 1 comprises a beam 11 connected to a wheel chassis 12. The wheel chassis 12 comprises wheels 13 at front and rear ends thereof. The wheels 13 may be activated either by a power unit or by manpower.

The lifting arm 2 is retractable and pivotally connected to an upper end of the beam 11. The lifting arm 2 is composed of a plurality of sections. One end of the lifting arm 2 is provided with a seat 21 and a handle 22.

The lifting unit 3 is connected to the lifting arm 2 and links the lifting arm 2 to retract or to extend. In this embodiment, the lifting unit 3 is a spiral rod set which is retractable. By the movement of the spiral rod set, the lifting arm 2 is linked to retract or to extend.

The power unit 4 is connected to the lifting unit 3 and provides power to the lifting unit 3.

The control unit 5 controls the power unit 4 to activate or to stop. The control unit 5 may be disposed on the main frame 1 for the user to operate or may be a separate part as a remote control either in a wire or wireless manner.

The knee support 6 is disposed at a lower section of the beam 11 of the main frame 1, and is provided with a knee pad 61.

The supporting unit 7 is composed of at least two rods in a retractable manner. A quick-release connector 71 is adapted to adjust the retraction or extension of the length of the rods. The supporting unit 7 has a first end 72 pivotally connected to the knee support 6 and a second end 73 pivotally connected to the lifting arm 2. The supporting unit 7 is to support the lifting arm 2.

The power unit 4 links the lifting unit 3 to move, which then links the lifting arm 2 to lift up or to lower down. The second end 73 of the supporting unit 7 is connected to the lifting arm 2 as a support. The lifting unit 3, as shown in FIG. 2, is a spiral rod set. An elevation unit 111 is provided in the main frame 1 to adjust the lifting unit 3 up or down.

Figure 3:
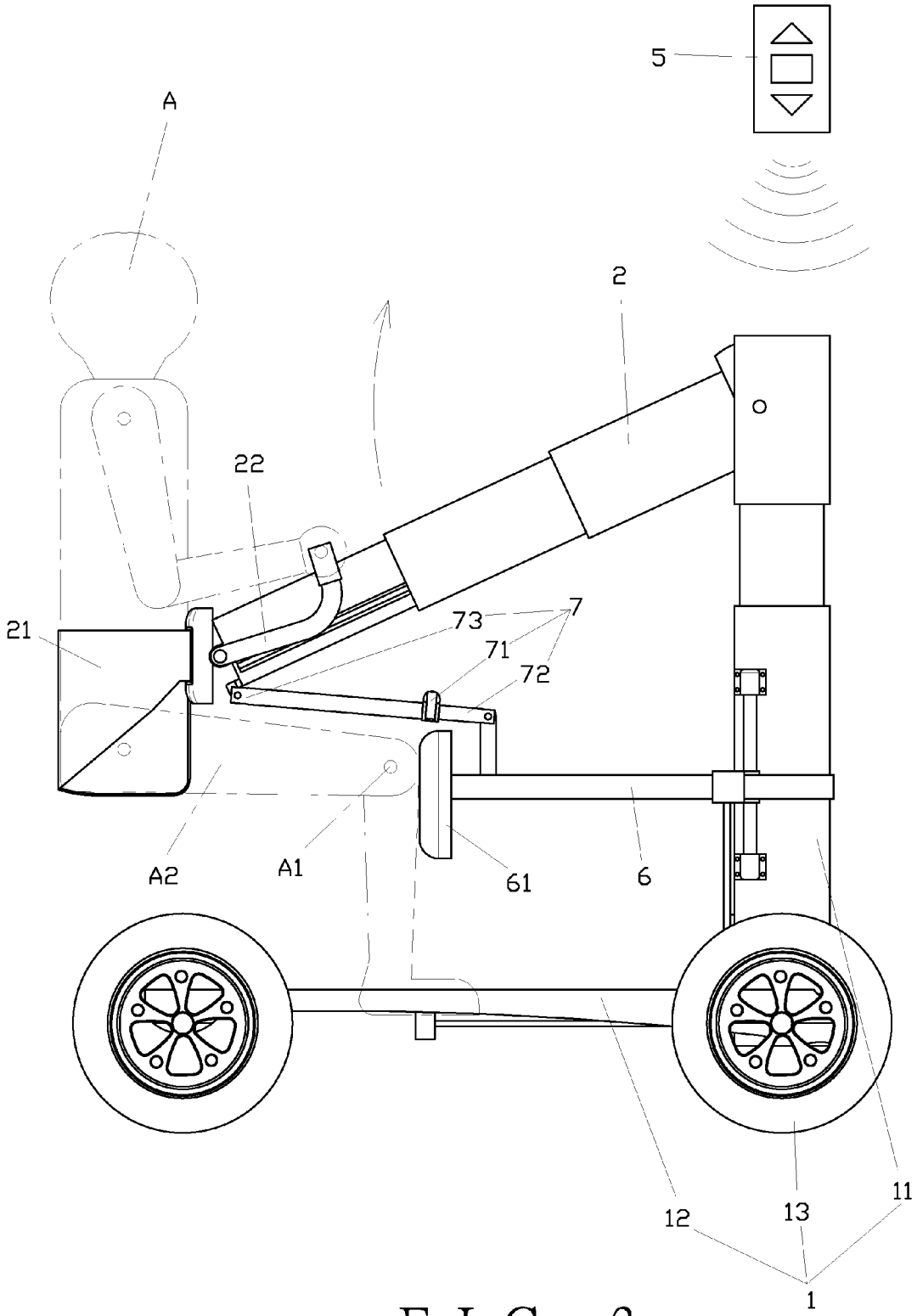
FIG. 3 is another side view showing a disabled person seating on the present invention.

To operate the present invention, as shown in FIG. 3, secure the hip of the disabled person A with a butt strap to the seat 21 of the lifting arm 2. The supporting unit 7 is adjusted to bring the knee plate 61 against the user's knee A1, corresponding in length to the thighs of the user. The user may hold the handle 22 to stay stably thereat.

Figure 4:
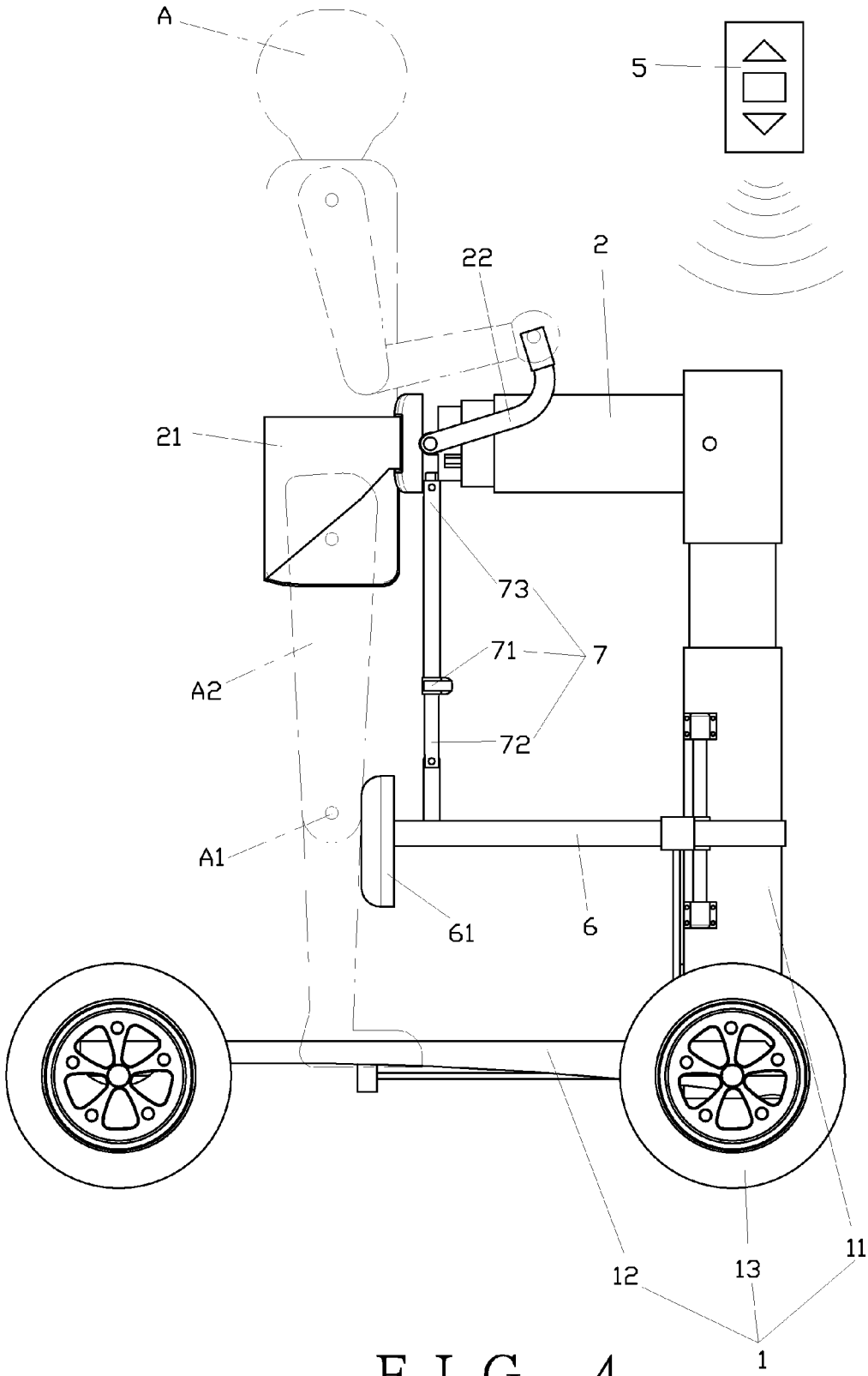
FIG. 4 is a side view showing that the disabled person is in a stand position through the assistance of the present invention.

When the control unit 5 activates the power unit 4, as shown in FIG. 4, the power unit 4 will link the lifting unit 3 to retract, which links the lifting arm 2 to rise simultaneously. The seat 21 is pulled to rise while the supporting unit 7 pulls up the lifting arm 2. Because the knee pad 61 remains contact with the user's knee, the user will be brought to stand up. The wheels 13 allow the user to move freely either by a helper to push the lift or by powered control.

When the disabled person A wants to seat down, the power unit 4 will link the lifting unit 3 to drop down. As shown in FIG. 3, the power unit 4 extends the lifting unit 3 outwardly, which brings the lifting arm 2 to lower down. The seat 21 helps the user to lower down softly, while the knee of the user remains contact with the knee pad 61.

The above-mentioned control unit and power unit are in a wire transmission manner for the user to control himself. They can be in a wireless transmission manner (wireless network, bluetooth, frequency modulation) in case the user can not control the lift himself.

What is claimed is:

1. A powered patient lift device comprising:

a main frame comprising a beam and a wheel chassis;

a lifting arm pivotally connected to said main frame in a retractable manner and comprising a seat at one end thereof;

a lifting unit connected to said lifting arm and linking said lifting arm to retract or to extend;

a power unit connected to said lifting unit and providing power to said lifting unit;

a control unit controlling said power unit;

a knee support disposed on said beam of said main frame and comprising a knee pad;

a supporting unit having a first end and a second end, said first end being pivotally connected to said knee support and said second end being pivotally connected to the end provided with said seat of said lifting arm.

2. The powered patient lift device, as recited in claim 1, wherein said wheel chassis of said main frame is provided with wheels.

3. The powered patient lift device, as recited in claim 1, wherein said control unit is disposed on said main frame.

4. The powered patient lift device, as recited in claim 1, wherein said control unit is a separate part from said main frame.

5. The powered patient lift device, as recited in claim 1, wherein said lifting arm is provided with a handle.

6. The powered patient lift device, as recited in claim 1, wherein said control unit controls said power unit in a wire transmission manner.

7. The powered patient lift device, as recited in claim 1, wherein said control unit controls said power unit in a wireless transmission manner.

8. The powered patient lift device, as recited in claim 1, wherein said lifting unit is a spiral rod set in a retractable manner.

9. The powered patient lift device, as recited in claim 1, wherein said supporting unit is a retractable rod composed of at least two sections, and is provided with a quick release connector.

* * * * *